US008360340B2

(12) United States Patent
Nadmitov

(10) Patent No.: US 8,360,340 B2
(45) Date of Patent: Jan. 29, 2013

(54) METHOD FOR SELECTIVE-REGULATING SPRAYING LIQUID AND A DEVICE FOR CARRYING OUT SAID METHOD

(76) Inventor: Sergei Viktorovich Nadmitov, Irkutsk (RU)

( * ) Notice: Subject to any disclaimer, the term of this patent is extended or adjusted under 35 U.S.C. 154(b) by 358 days.

(21) Appl. No.: 12/733,648

(22) PCT Filed: Aug. 28, 2008

(86) PCT No.: PCT/RU2008/000578

§ 371 (c)(1),
(2), (4) Date: Mar. 11, 2010

(87) PCT Pub. No.: WO2009/038498

PCT Pub. Date: Mar. 26, 2009

(65) Prior Publication Data

US 2010/0200669 A1 Aug. 12, 2010

(30) Foreign Application Priority Data

Sep. 19, 2007 (RU) ..... 2007134923

(51) Int. Cl.
*B05B 7/00* (2006.01)

(52) U.S. Cl. ..... 239/8; 239/124; 239/125; 239/429; 239/433

(58) Field of Classification Search ..... 239/1, 8, 239/124, 125, 127, 127.3, 338, 398, 427, 239/427.3, 429, 433, 434; 137/563
See application file for complete search history.

(56) References Cited

U.S. PATENT DOCUMENTS 6,874,700 B2 * 4/2005 Ham et al. ..... 239/127
7,128,276 B2 * 10/2006 Nilsen et al. ..... 239/124
2005/0118110 A1 * 6/2005 Khang et al. ..... 424/45

FOREIGN PATENT DOCUMENTS

| | | |
|---|---|---|
| SU | 246200 | 11/1969 |
| SU | 735315 | 5/1980 |
| SU | 797783 | 1/1981 |
| SU | 1212600 | 2/1986 |

* cited by examiner

*Primary Examiner* — Darren W Gorman
(74) *Attorney, Agent, or Firm* — Aleksandr Smushkovich

(57) ABSTRACT

The invention relates to methods and devices for spraying liquid during production processes requiring a uniform dispersion mixture, in particular in internal combustion engines requiring a fine fuel-air mixture, in the chemical industry for apparatuses for rinsing gas with liquid, which require a uniform coarse-dispersion mixture for reducing the drop entrainment of a rinsing liquid. The inventive method consists in collecting, during the liquid spraying, which is carried out by injecting a liquid at an angle to a gas flow, particles in those sectors of the spray cone that are appropriate to particles of specified sizes. The liquid spraying and collecting processes are carried out at one section of a laminar unidirectional gas flow. The collected particles form, when accumulated, a liquid that is returned for re-spraying. The inventive device comprises a body (1) with an internal channel (2) for providing a laminar unidirectional gas flow, a spray nozzle (3) which is placed at an angle to the gas flow direction and is connected to a liquid feed pipe (6) and a collector for particles (4) which is made and placed in such a manner that it is able to collect particles in those sectors of the spray cone that are appropriate to particles of specified sizes. In the first variant, the collector is connected to a pipe for returning the liquid for re-spraying (5), and in the second variant, the collector is connected to an additional spray nozzle (7) made in the internal channel of the body.

4 Claims, 3 Drawing Sheets

METHOD FOR SELECTIVE-REGULATING SPRAYING LIQUID AND A DEVICE FOR CARRYING OUT SAID METHOD

CROSS-REFERENCE TO RELATED APPLICATIONS

This application is a U.S. national stage application of a PCT application PCT/RU2008/000578 filed on 28 Aug. 2008, published as WO/2009/038498, whose disclosure is incorporated herein in its entirety by reference, which PCT application claims priority of a Russian Federation application RU2007134923 filed on 19 Sep. 2007.

FIELD OF THE INVENTION

The invention relates to methods and devices for spraying liquid during production processes requiring a uniform dispersion mixture, in particular in internal combustion engines requiring a fine fuel-air mixture, in the chemical industry for apparatuses for rinsing gas with liquid that require a uniform coarse-dispersion mixture for reducing the drop entrainment of a rinsing liquid.

BACKGROUND OF THE INVENTION

Many devices are known for spraying liquid during production processes that use the method of pneumatic spraying and belong to jet devices. Jet devices are those where a process of exchanging kinetic energy from one flow to another takes place by immediate mixing. Despite a variety of jet device constructions the following basic elements can be noted: an active nozzle, a mixing chamber, a diffusor, an input part of the throat for passive flow, which is usually made in the form of a confusor (New reference book for chemist and technologist. Processes and apparatuses for chemical technology, part 1, St. Peterburg, ANO NPO "Professional", 2004, on page 405). A disadvantage of such devices is the inhomogeneity of the resulting mixture, i.e. diameter of particles vary widely and the particle size distribution is very non-uniform. For example, there are not many large particles but they have the most part of fuel mass (Morozov K. A. Matuhin L. N. Feeding systems of modern petrol engines, Manual, MADI, M., 1988, on page 7).

One device is known from inventor's certificate of USSR N2797783 of 1981. The device comprises air-supply and fluid-supply systems, a spray chamber with input and output pipes, sprayers and a liquid collector. Sprayers are chordally installed in the spray chamber. Disadvantages of this device are high aerodynamic resistance, large size and high material consumption, and impossibility of production of a homogeneous coarse-dispersion mixture. The following cause these disadvantages. The cylindrical part of the spray chamber, where sprayers are chordally installed, enforces rotary moving gas inside the chamber. It results in high aerodynamic resistance in comparison with laminar unidirectional gas flow. The spray chamber has to measure a certain size to set up rotary movement of a gas flow. It is necessary to enlarge the diameter of the cylindrical part in order to reduce aerodynamic resistance. The large size of the device predetermines its high material consumption. When a gas flow is moving in a rotary manner, particles of all sizes except the smallest ones are collected on the internal side of the chamber. The smallest particles are held in the rotary gas flow, not for their low sedimentation velocity, which is determined by the relation of aerodynamic forces to mass of a particle, but due to mechanism of Brownian movements acting, as it is known, on particles of sizes that do not exceed many times the sizes of gas molecules.

One more device is known from inventor's certificate of USSR N2246200 of 1969 (point 2). The device comprises a case, a water sprayer and a water collector connected to the water sprayer. The water sprayer is made in the form of a set of pipes with perforated sides. Pipes are placed in the case and are parallel to the air flow direction. A disadvantage of this device is inhomogeneity of the resulting mixture. The following cause this disadvantage. A liquid goes out of the end faces and many apertures in the pipe sides. A liquid is broken down into particles of various sizes that are carried away so it forms a set of spray cones. Sectors with prevailing large, medium and small particles can be found in every spray cone except spray cones from the pipe end faces. Many spray cones overlay one upon another in an irregular way and form a flow of a liquid spray where particles of various sizes are distributed uniformly. As a result, large, medium and small particles are collected in a nonselective way on the sides of the case. The collected particles form, when accumulated, a liquid that is returned for re-spraying.

The most similar to technical essence of the inventive method is the method for spraying liquid (prototype), described in the book Morozov K. A. Matuhin L. N. Feeding systems of modern petrol engines, Manual, MADI, M., 1988, on page 7. The method consists in injecting liquid at an angle into a gas flow. A disadvantage of the method is inhomogeneity of the resulting mixture that increases fuel consumption in internal combustion engines because of incomplete combustion of large particles of fuel.

The most similar to technical essence of the inventive device is the device for spraying liquid (prototype), described in the book Dmitrievskij A. V., Kamenev V. F. Automobile carburetors. M: Mechanical engineering, 1990, on pages 76-77. The device comprises a body with an internal channel, which is made in the form of a Venturi pipe, and a spray nozzle placed in the narrow part of the internal channel at an angle to the gas flow direction. A disadvantage of this device is inhomogeneity of the resulting mixture that increases fuel consumption in internal combustion engines because of incomplete combustion of large particles of fuel.

SUMMARY AND BRIEF DESCRIPTION OF THE INVENTION

The present invention solves the problem of homogeneous enhancement for a mixture, which is produced in spraying liquid by injection of a liquid into a gas flow. In order to solve the problem, spraying is carried out by injection of a liquid into a gas flow at an angle to the gas flow direction but not parallel. The gas flow breaks down a liquid flow into particles of various sizes and carries them away so it forms a spray cone. The trajectories of large particles deviate from a spray nozzle further than the trajectories of small particles do. It is due to an action of the field of aerodynamic forces and the initial momentum of a liquid, which goes out of the nozzle at an angle to the gas flow direction and is broken down into particles. It brings to the non-uniform particle size distribution in the spray cone, i.e. the different sectors with prevailing large, medium and small particles are formed. The illustration of dividing the spray cone into sectors with particles of various sizes is given in FIG. 3.

Particles of specified sizes in the resulting spray cone are selected (removed), i.e. particles of such sizes that are undesirable for whatever reason. If large and medium particles in the spray cone are removed then small particles remain. If medium and small particles are removed then large particles remain. If medium particles are removed then large and small particles remain. Selection (removal) of particles is carried out as follows. A collector for particles of a liquid spray is installed at some distance from the spray nozzle. The collector is made and placed to be able to collect particles of specified sizes in those sectors of the spray cone that are appropriate to particle sizes. It is necessary and sufficient for selection (removal) of particles of specified sizes that the collector collects all particles of a liquid spray. In addition, the collector should be placed in the appropriate sectors of the spray cone. Particles, which are collected by the collector for particles of a liquid spray, form, when accumulated, a liquid that is returned for re-spraying (recirculating). The processes of spraying liquid and selecting (removing) particles of specified sizes in the spray cone are carried out in one section of a laminar gas flow, which has no turns and rotations.

The technical result is the production of a mixture that is more homogenous in terms of the particle sizes due to removing particles of specified sizes in the spray cone where specified sizes depend on a variant of the method usage or the purpose of the device.

The inventive concept consists in departure from known technical decisions where at first a liquid is sprayed and a flow with large and small particles uniformly distributed is obtained. Further, particles of specified sizes in a flow are separated and removed. Instead of doing so, liquid is sprayed in such a manner that spatial separation of particles of various sizes takes place in the very spray cone at the same time as spraying liquid. In this case removing particles of specified sizes reduces to removing particles of all sizes in the appropriate sectors of the spray cone. Mathematical modeling proves the efficiency of such approach to solving the problem of homogeneous enhancement for spraying liquid. It shows that the determinant influence for the whole trajectory has only the initial phase of the trajectory where particles appear from a liquid flow and have minimum velocity. The less velocity a particle has the more easily its trajectory can be changed. As a particle of a liquid accelerates, it becomes more difficult to change its trajectory.

According to the invention, the technical result for the method (production of a mixture that is more homogeneous in terms of particle sizes) is achieved due to spraying liquid by injection of a liquid through a spray nozzle at an angle to the gas flow direction. In addition, a process of selection of (removal of) particles of specified sizes is carried out in a spray cone simultaneously with the process of spraying. The process of selection is carried out by a collector for particles of a liquid spray that is installed at some distance from the spray nozzle and it is made and placed to be able to collect particles of a liquid spray in those sectors of the spray cone that are appropriate to particle sizes. The processes of spraying liquid and selection of (removal of) particles of specified sizes are carried out in one section of a laminar gas flow, which has no turns and rotations. Particles of a liquid spray, which are collected by the collector, form, when accumulated, a liquid that is returned for re-spraying.

The common element with the known method for spraying liquid is spraying liquid by injection through a spray nozzle at an angle to the gas flow direction.

The new elements, which differentiate the inventive method from the prototype, are the following:

the process of selection of (removal of) particles of specified sizes is carried out in the spray cone simultaneously with the process of spraying;

the process of selection (removal) is carried out by the collector for particles of a liquid spray that is installed at some distance from the spray nozzle and it is made and placed to be able to collect particles of a liquid spray in those sectors of the spray cone that are appropriate to particle sizes;

the processes of spraying liquid and selection of (removal of) particles of specified sizes are carried out in one section of a laminar gas flow, which has no turns and rotations;

particles of a liquid spray, which are collected by the collector, form, when accumulated, a liquid that is returned for re-spraying.

According to the invention, the technical result for the device of variant No. 1 (production of a mixture that is more homogeneous in terms of particle sizes) is achieved due to a device comprising: a body with an internal channel, a spray nozzle, which is placed at an angle to the gas flow direction and is connected to a liquid feed pipe, a collector for particles of a liquid spray, which is installed at some distance from the spray nozzle and it is made and placed to be able to collect particles of specified sizes in those sectors of the spray cone that are appropriate to particle sizes. The internal channel is made to be able to provide a laminar gas flow, which has no turns and rotations, in the section that starts before the spray nozzle and ends at the collector for particles of a liquid spray. The collector for particles of a liquid spray is connected to a pipe for returning a liquid for re-spraying.

The common elements with the device known from prototype are:

the body with the internal channel;

the spray nozzle, which is placed at an angle to the gas flow direction and is connected to the liquid feed pipe.

The new elements, which differentiate the inventive device from the prototype, are:

the collector for particles of a liquid spray which is installed at some distance from the spray nozzle and it is made and placed to be able to collect particles of specified sizes in those sectors of the spray cone that are appropriate to particle sizes;

the internal channel, which is made to be able to provide a laminar gas flow, which has no turns and rotations, in the section that starts before the spray nozzle and ends at the collector for particles of a liquid spray;

the collector for particles of a liquid spray, which is connected to the pipe for returning a liquid for re-spraying.

According to the invention, the technical result for the device of variant No. 2 (production of a mixture that is more homogeneous in terms of particle sizes) is achieved due to a device comprising: a body with an internal channel, a spray nozzle, which is placed at an angle to the gas flow direction and is connected to a liquid feed pipe, a collector for particles of a liquid spray, which is installed at some distance from the spray nozzle and it is made and placed to be able to collect particles of specified sizes in those sectors of the spray cone that are appropriate to particle sizes. The internal channel is made to be able to provide a laminar gas flow, which has no turns and rotations, in the section that starts before the spray nozzle and ends at the collector for particles of a liquid spray. The collector for particles of a liquid spray is connected via a pipe for returning a liquid for re-spraying to an additional spray nozzle, which is made and placed to be able to overlay the appropriate sectors of the spray cones regarding those sectors of both spray cones where particles are collected.

The common elements with the device known from prototype are:

the body with the internal channel;

the spray nozzle, which is placed at an angle to the gas flow direction and connected to the liquid feed pipe.

The new elements, which differentiate the inventive device from the prototype, are:

the collector for particles of a liquid spray, which is installed at some distance from the spray nozzle and it is made and placed to be able to collect particles of specified sizes in those sectors of the spray cone that are appropriate to particle sizes;

the internal channel, which is made to be able to provide a laminar gas flow, which has no turns and rotations, in the section that starts before the spray nozzle and ends at the collector for particles of a liquid spray;

the collector for particles of a liquid spray is connected via the pipe for returning a liquid for re-spraying to the additional spray nozzle, which is made and placed to be able to overlay the appropriate sectors of the spray cones regarding those sectors of the both spray cones where particles are collected by the collector for a liquid spray.

DESCRIPTION OF THE PREFERRED EMBODIMENTS

Figure 1:
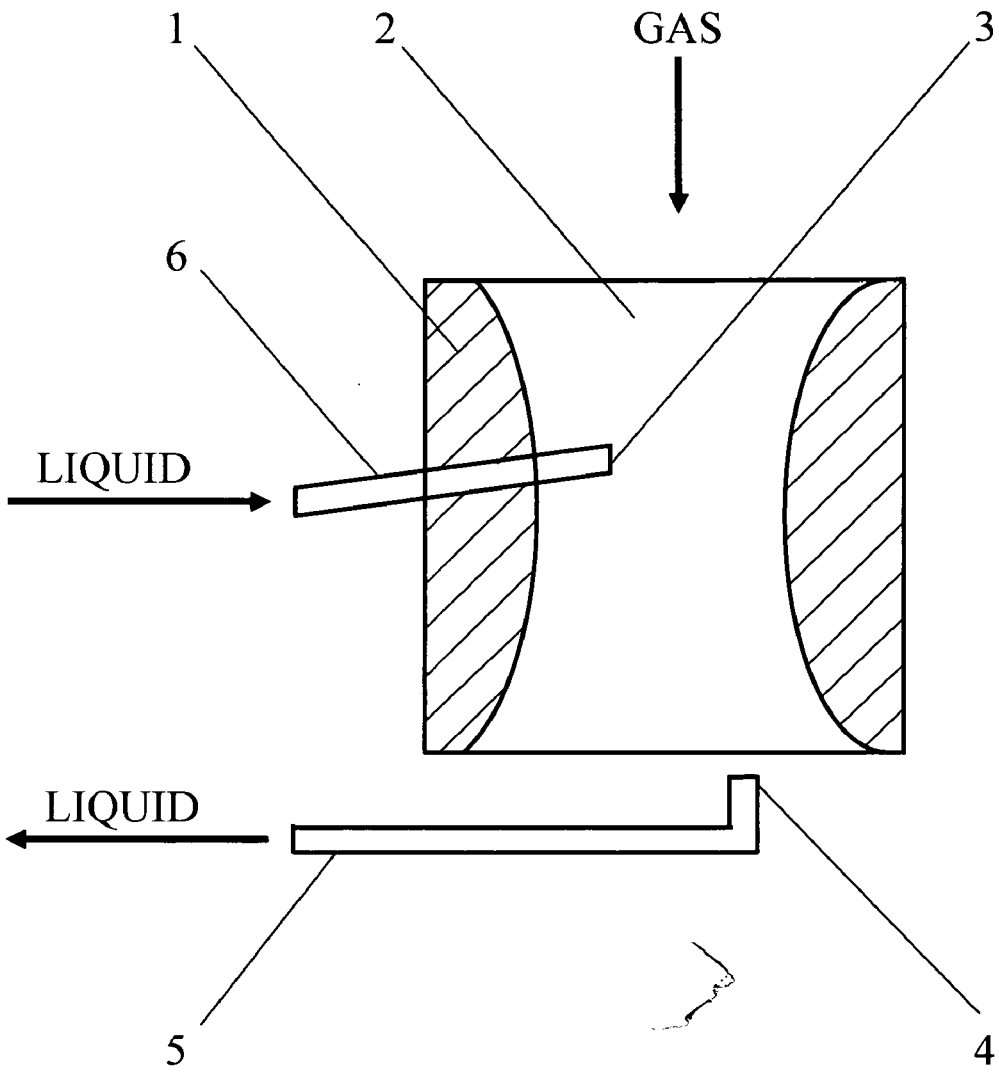
FIG. 1 shows the device of variant No. 1.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

Therefore, according to variant No. 1 of the present invention, the inventive device comprises: a body (1) with an internal channel (2) capable of creating a laminar unidirectional gas flow having a direction, said internal channel (2) having an intake end for entering said gas flow, and a discharge end for exiting said gas flow; a liquid feed pipe (6) for supplying said liquid into said internal channel (2), said liquid feed pipe (6) having an end furnished with a spray nozzle (3) placed within said internal channel (2) at a predetermined angle to said direction of the gas flow, said spray nozzle (3) producing a spray conical distribution of liquid particles of different sizes, wherein a specific sector of the spray conical distribution corresponds to a specific particle size; a collector (4) for collecting particles of the liquid of a specified size, said collector (4) is disposed in a predetermined sector of said spray conical distribution with respect to the predetermined size of particles at the second end of said internal channel (2); and a returning pipe (5) having a first end connected to said collector (4) and a second end substantially associated with said spray nozzle (3) for re-spraying the liquid.

Additionally, for the inventive device of variant No. 1, there is proposed a method for selective-recirculating spraying a liquid comprising the steps of: —providing a body (1) with an internal channel (2) capable of creating a laminar unidirectional gas flow having a direction, said internal channel (2) having an intake end for entering said gas flow, and a discharge end for exiting said gas flow; a liquid feed pipe (6) for supplying said liquid into said internal channel (2), said liquid feed pipe (6) having an end furnished with a spray nozzle (3) placed within said internal channel (2) at a predetermined angle to said direction of the gas flow, said spray nozzle (3) producing a spray conical distribution of liquid particles of different sizes, wherein a specific sector of the spray conical distribution corresponds to a specific particle size; a collector (4) for collecting particles of the liquid of a predetermined size, said collector (4) is disposed in a predetermined sector of said spray conical distribution with respect to the predetermined size of particles at the second end of said internal channel (2); a returning pipe (5) having a first end connected to said collector (4) and a second end substantially associated with said spray nozzle (3) for re-spraying the liquid; —inputting said gas flow into said intake end of the internal channel (2); —inputting said liquid via said spray nozzle into the internal channel (2); —collecting particles of the liquid of said predetermined size; and —returning the collected particles of the liquid of said predetermined size to said spray nozzle (3) for re-spraying.

According to variant No. 2 of the present invention, the inventive device comprises: a body (1) with an internal channel (2) capable of creating a laminar unidirectional gas flow having a direction, said internal channel (2) having an intake end for entering said gas flow, and a discharge end for exiting said gas flow; a liquid feed pipe (6) for supplying said liquid into said internal channel (2), said liquid feed pipe (6) having an end furnished with a first spray nozzle (3) placed within said internal channel (2) at a predetermined angle to said direction of the gas flow; a second spray nozzle (7) placed within said internal channel (2) at a predetermined angle to said direction of the gas flow, thereby producing a spray conical distribution of liquid particles of different sizes, wherein a specific sector of the spray conical distribution corresponds to a specific particle size; a collector (4) for collecting particles of the liquid of a predetermined size, said collector (4) is disposed in a predetermined sector of said spray conical distribution with respect to the predetermined size of particles at the second end of said internal channel (2); a returning pipe (5) having a first end connected to said collector (4) and a second end connected to said second spray nozzle (7) for re-spraying the liquid, thereby providing for a conical distribution of liquid particles of the predetermined size; wherein said second spray nozzle (7) is placed to be capable of overlaying said conical distribution of liquid particles of the predetermined size on said conical distribution of liquid particles of different sizes.

Additionally, for the inventive device of variant No. 2, there is proposed a method for selective-recirculating spraying a liquid comprising the steps of: —providing the device of variant No. 2, described above; —inputting said gas flow into said intake end of the internal channel (2); —inputting said liquid via said spray nozzle (3) into the internal channel (2); —collecting particles of the liquid of said predetermined size; and—returning the collected particles of the liquid of said predetermined size to said second spray nozzle (7) for re-spraying.

The inventive method is carried out as follows. A liquid is injected through a spray nozzle at an angle of 90° to the gas flow direction. The gas flow breaks down the liquid flow, which goes out of the spray nozzle, into particles of various sizes and carries them away so that it forms a spray cone. The trajectories of large particles deviate from the spray nozzle further than the trajectories of small particles do. It is due to an action of the field of aerodynamic forces and the initial momentum of a liquid, which goes out of the nozzle at an angle to the gas flow direction, and is broken down into particles. It brings to the non-uniform particle size distribution in the spray cone and different sectors with prevailing large, medium and small particles being formed. The illustration of dividing the spray cone into sectors with particles of various sizes is given in FIG. 3. The process of selection of (removal of) particles of specified sizes in the spray cone is carried out simultaneously with the process of spraying. The process of selection (removal) is carried out by a collector for particles of a liquid spray that is installed at some distance from the spray nozzle and it is made and placed to be able to collect particles of specified sizes in those sectors of the spray cone that are appropriate to particles of specified sizes. The processes of spraying liquid and selection (removal) of particles of specified sizes in the spray cone are carried out in one section of a laminar unidirectional gas flow. Particles of a liquid spray, which are collected by the collector, form, when accumulated, a liquid, which is returned for re-spraying. After selection (removal) of particles of specified sizes in the spray cone, it is characterized as more homogeneous in terms of particle sizes.

The spray nozzle is made in the form of the end of a pipe. Other embodiments of the spray nozzle are possible. It is necessary and sufficient to realize that the function of the spray nozzle is to direct a liquid flow. This function in combination with other elements provides the possibility to achieve the technical result.

The angle between the spray nozzle and the gas flow direction is 90°. Other values of the angle are possible. It is necessary and sufficient that a liquid flow is not parallel to the gas flow direction. It provides the non-uniform distribution of large and small particles in the spray cone. The angle in combination with other elements provides the possibility to achieve the technical result.

The collector for particles of a liquid spray is made in the form of the end of a pipe. The collector is installed at some distance from the spray nozzle. It is made and placed to be able to collect particles of a liquid spray in those sectors of the spray cone that are appropriate to particles of specified sizes. There is some distance between the end of the pipe and the spray nozzle. Some distance is necessary for starting the process of breaking down a liquid flow into particles. The end of the pipe is made and placed in those sectors of the spray cone that are appropriate to particles of specified sizes. It is possible to embody the collector for particles of a liquid spray in the form of socket pipes, rings, plates, parts of the internal channel and other embodiments. It is necessary and sufficient to realize that the function of the collector for particles of a liquid spray is to select (remove) particles of a liquid spray in those sectors of the spray cone that are appropriate to particles of specified sizes. This function in combination with other elements provides the possibility to achieve the technical result.

The processes of spraying liquid and selecting particles of specified sizes in the spray cone are carried out in one section of a laminar unidirectional gas flow. This condition of passing processes is achieved due to the arrangement of the spray nozzle and the collector for particles in the rectilinear channel. Other known methods are possible. It is necessary and sufficient to provide just the condition but not a particular method or material means. This condition in combination with other elements provides the possibility to achieve the technical result.

According to variant No. 1, the inventive device comprises a body 1 with an internal channel 2, made in the form of a Venturi pipe. There is a spray nozzle 3 in the narrow part of the internal channel 2. The spray nozzle is placed at an angle of about 90° to the gas flow direction and it is connected to a liquid feed pipe 6. A collector 4 for particles of a liquid is installed at some distance from the spray nozzle 3. It is made and placed to be able to collect particles of specified sizes in those sectors of the spray cone that are appropriate to particle sizes. The collector 4 is connected to a pipe for returning a liquid for re-spraying 5.

The device of variant No. 1 works as follows. A gas flow goes through the internal channel 2 where its rate increases and depression takes place. A liquid goes through the feed pipe 6 to the spray nozzle 3 and goes out of it under the influence of this depression. The gas flow breaks down the liquid flow, which goes out of spray nozzle 3, into particles of various sizes and carries them away so it forms a spray cone. The trajectories of large particles deviate from a spray nozzle further than the trajectories of small particles do. It is due to an action of the field of aerodynamic forces and the initial momentum of a liquid, which goes out of the nozzle at an angle to the gas flow direction and is broken down into particles. The non-uniformly sized particles are distributed in the spray cone, i.e. the different sectors with prevailing large, medium and small particles are formed. The illustration of dividing the spray cone into sectors with particles of various sizes is given in FIG. 3. Particles of specified sizes are collected in the appropriate sectors of the spray cone by the collector 4. The collector 4 is installed at a predetermined distance from the spray nozzle 3. This distance can be chosen by the designer taking into account a particular device to be designed according to the present invention. It is made and placed to be able to collect particles of specified sizes in those sectors of the spray cone that are appropriate to particles of specified sizes. Particles of the liquid spray are collected in the collector 4. They form, when accumulated, a liquid, which is drawn under the influence of aerodynamic forces to the pipe for returning the liquid for re-spraying 5. It means re-spraying by the spray nozzle 3. Particular detail is not specified as it is easy to do and it is not essential for this invention. After collecting (removing) particles of the specified sizes in the spray cone, it is characterized as more homogeneous in terms of particle sizes.

The spray nozzle 3 is made in the form of the end of a pipe 6. Other embodiments of the spray nozzle 3 are possible. It is necessary and sufficient to realize that the function of the spray nozzle is to direct a liquid flow. This function in combination with other elements provides the possibility to achieve the technical result.

The angle between the spray nozzle 3 and the gas flow direction is about 90°. Other values of the angle are possible. It is necessary and sufficient that the liquid flow be not parallel to the gas flow direction. It provides the non-uniform distribution of large and small particles in the spray cone. The angle in combination with other elements provides the possibility to achieve the technical result.

The internal channel 2 is made in the form of a Venturi pipe. This form of the internal channel 2 gives the possibility of providing a laminar unidirectional gas flow in the section that starts before the spray nozzle and ends at the collector for particles of a liquid spray. Secondly, it makes depression in the narrow part of the channel 2 and provides moving a liquid to the spray nozzle 3. It is possible to embody the internal channel 2 in the form of pipes having round, square and other section, in the form of confusor, diffusor and other forms, which provides a laminar unidirectional gas flow in the section that starts before the spray nozzle 3 and ends at the collector 4. It is necessary and sufficient to realize that the function of the internal channel 2 is to provide a laminar unidirectional gas flow in the section that starts before the spray nozzle 3 and ends at the collector 4. This function in combination with other elements provides the possibility to achieve the technical result.

The collector 4 is made in the form of the end of the pipe 5 (as shown on FIG. 1). The collector 4 is installed at a predetermined distance from the spray nozzle 3. This distance can be chosen by the designer taking into account a particular device to be designed according to the present invention. It is made and placed to be able to collect particles of a liquid spray in those sectors of the spray cone that are appropriate to particles of specified sizes. There is some distance between the end of the pipe 5 (i.e. the collector 4) and the spray nozzle 3 (as shown on FIG. 1). Some distance is necessary for starting the process of breaking down a liquid flow into particles. The end of the pipe 5 is made and placed in those sectors of the spray cone that are appropriate to particles of specified sizes. It is possible to embody the collector 4 in the form of socket pipes, rings, plates, parts of the internal channel 2 and other embodiments. It is necessary and sufficient to realize that the function of the collector for particles of a liquid spray 4 is to select (remove) particles of a liquid spray in those sectors of the spray cone that are appropriate to particles of specified sizes. This function in combination with other elements provides the possibility to achieve the technical result.

Figure 2:
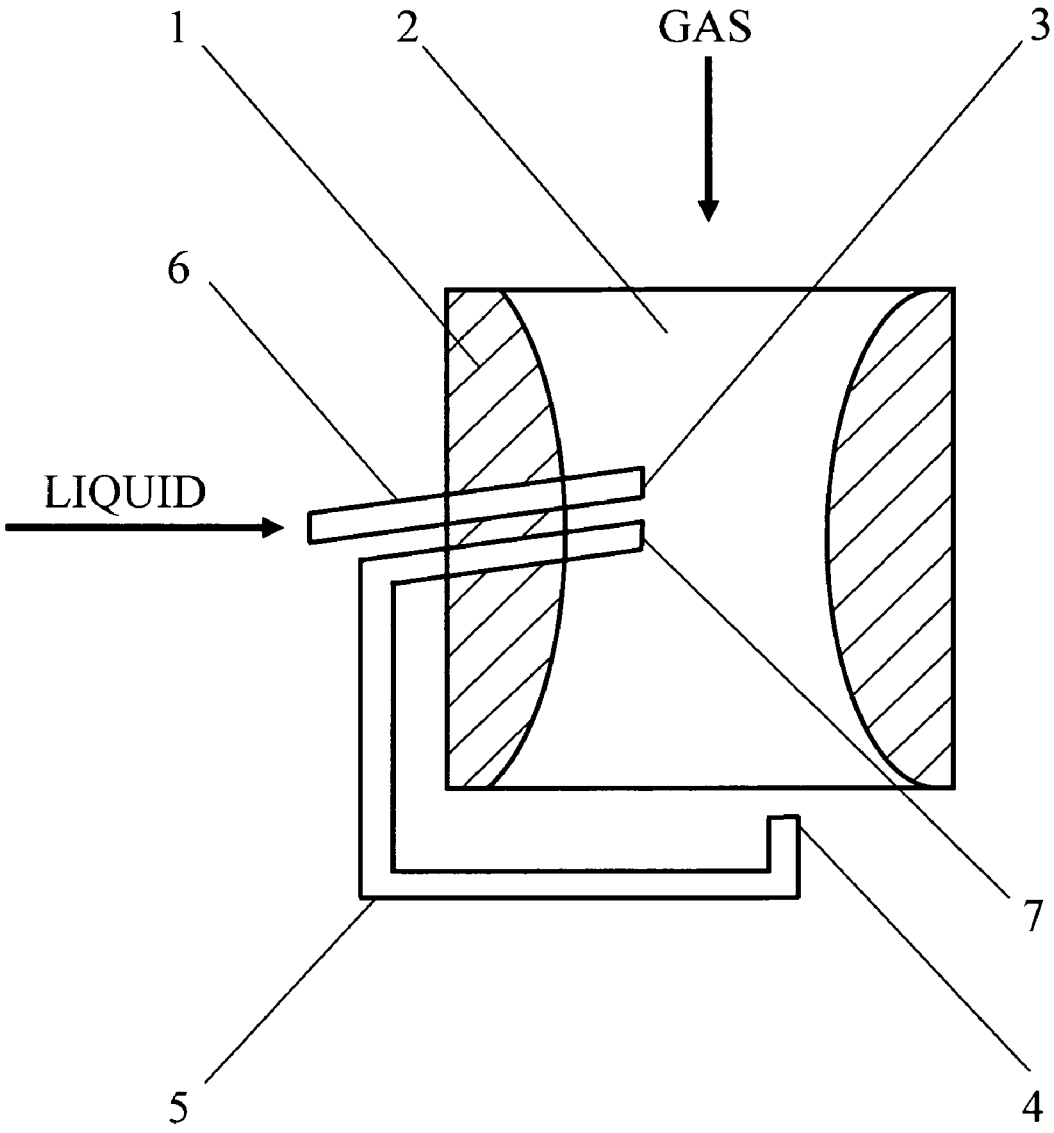
FIG. 2 shows the device of variant No. 2.

According to variant No. 2 (FIG. 2) the inventive device comprises a body 1 with an internal channel 2, made in the form of a Venturi pipe. There is a spray nozzle 3 in the narrow part of the internal channel 2. The spray nozzle is placed at an angle of about 90° to the gas flow direction and it is connected to a liquid feed pipe 6. A collector 4 is installed at a predetermined distance from the spray nozzle 3. This distance can be chosen by the designer taking into account a particular device to be designed according to the present invention. It is made and placed to be able to collect particles of specified sizes in those sectors of the spray cone that are appropriate to particle sizes. The collector 4 is connected via a pipe 5 for returning a liquid for re-spraying 5 to an additional spray nozzle 7 that is placed at an angle of 90° to the gas flow direction predeterminedly close to the spray nozzle 3. This distance can also be chosen by the designer taking into account a particular device to be designed according to the present invention.

Figure 3:
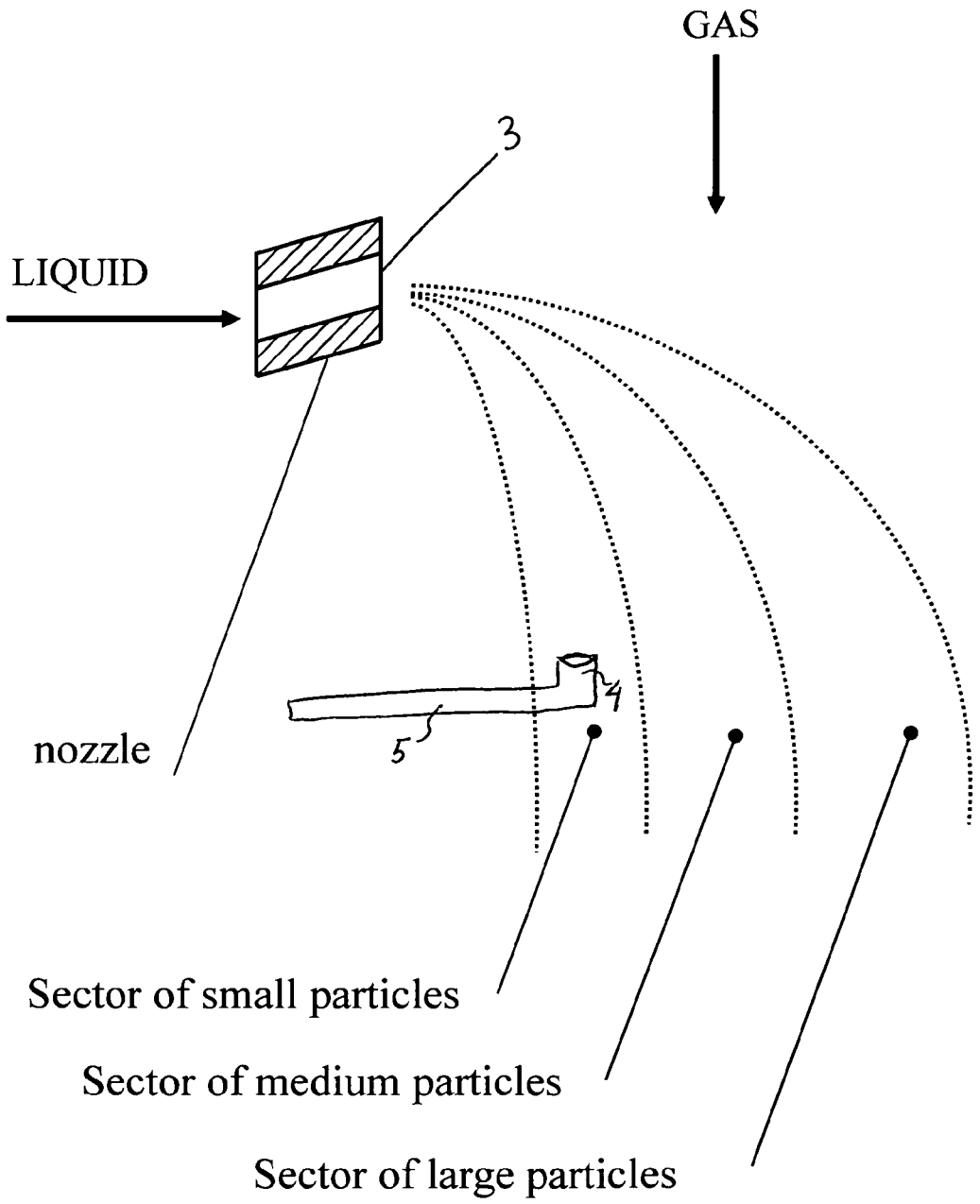
FIG. 3 is an illustration of dividing the spray cone into sectors with particles of various sizes.

The device of variant No. 2 works as follows. A gas flow moves through the internal channel 2 where its rate increases and depression takes place. A liquid is drawn through the feed pipe 6 to the spray nozzle 3 and exits it under the influence of this depression. The gas flow breaks down the liquid flow, which is sprinkled from the spray nozzle 3, being broken down into particles of various sizes and carries them away, thereby forming a spray cone. The trajectories of large particles deviate from the spray nozzle further than the trajectories of small particles do. It is due to an action of the field of aerodynamic forces and the initial momentum of the liquid, which exits of the nozzle at an angle to the gas flow direction and is broken down into particles. The non-uniformly sized particles are distributed in the spray cone, i.e. the different sectors with prevailing large, medium and small particles are formed. The illustration of dividing the spray cone into sectors with particles of various sizes is shown in FIG. 3. Particles of specified sizes are collected in the appropriate sectors of the spray cone by the collector 4. The collector 4 is installed at a predetermined distance from the spray nozzle 3. This distance can be chosen by the designer taking into account a particular device to be designed according to the present invention. It is made and placed to be able to collect particles of specified sizes in those sectors of the spray cone that are appropriate to particles of specified sizes. Particles of the liquid spray are collected in the collector 4. They form, when accumulated, a liquid, which is drawn under the influence of aerodynamic forces to the pipe 5 for returning the liquid for re-spraying, and further moves to the additional spray nozzle 7 (as shown on FIG. 2). The additional spray nozzle 7 forms its spray cone in such a manner that the appropriate sectors of both spray cones from the spray nozzle 3 and the additional spray nozzle 7 are coincident. After selecting (removing) the particles of specified sizes from the spray cone, it is characterized as more homogeneous in terms of particle sizes.

The spray nozzle 3 is made in the form of the end of a pipe 6. Other embodiments of the spray nozzle 3 are possible. It is necessary and sufficient to realize that the function of the spray nozzle is to direct a liquid flow. This function in combination with other elements provides the possibility to achieve the technical result.

The angle between the spray nozzle 3 and the gas flow direction is about 90°. Other values of the angle are possible. It is necessary and sufficient that a liquid flow is not parallel to the gas flow direction. It provides the non-uniform distribution of large and small particles in the spray cone. The angle in combination with other elements provides the possibility to achieve the technical result.

The internal channel 2 is made in the form of a Venturi pipe. This form of the internal channel 2 gives the possibility of providing a laminar unidirectional gas flow in the section that starts before the spray nozzle and ends at the collector for particles of a liquid spray. Secondly, it makes depression in the narrow part of the channel 2 and provides moving a liquid to the spray nozzle 3. It is possible to embody the internal channel 2 in the form of pipes having round, square and other section, in the form of confusor, diffusor and other forms, which provide a laminar unidirectional gas flow in the section that starts before the spray nozzle 3 and ends at the collector 4. It is necessary and sufficient to realize that the function of the internal channel 2 is to provide a laminar unidirectional gas flow in the section which starts before the spray nozzle 3 and ends at the collector for particles of a liquid spray 4. This function in combination with other elements provides the possibility to achieve the technical result.

The collector 4 is represented by the end of the pipe 5. The collector 4 is installed at a predetermined distance from the spray nozzle 3. This distance can be chosen by the designer taking into account a particular device to be designed according to the present invention. It is made and placed to be able to collect particles of a liquid spray in those sectors of the spray cone that are appropriate to particles of specified sizes. There is some distance between the end of the pipe 5 and the spray nozzle 3. Some distance is necessary for starting the process of breaking down a liquid flow into particles. The end of the pipe 5 is made and placed in those sectors of the spray cone that are appropriate to particles of specified sizes. It is possible to embody the collector 4 in the form of socket pipes, rings, plates, parts of the internal channel 2 and other embodiments. It is necessary and sufficient to realize that the function of the collector for particles of a liquid spray 4 is to select (remove) particles of a liquid spray in those sectors of the spray cone that are appropriate to particles of specified sizes. This function in combination with other elements provides the possibility to achieve the technical result.

The additional spray nozzle 7 is represented by the end of the pipe 5. It is made and placed to be able to overlay the appropriate sectors of the spray cones regarding those sectors of both spray cones where particles of specified sizes are collected by the collector 4. The end of the pipe 5 (i.e. the nozzle 7) is made and placed in such a manner that the appropriate sectors of both spray cones are coincident. Other embodiments and placement arrangements of the additional spray nozzle 7 are possible. It is necessary and sufficient to realize that the function of the additional spray nozzle 7 is to spray a liquid with the possibility of overlaying the appropriate sectors of the spray cones regarding those sectors of both spray cones where particles of specified sizes are collected by the collector 4.

What is claimed is:

1. A method for selective-recirculating spraying a liquid comprising the steps of:

providing a body (1) with an internal channel (2) capable of creating a laminar unidirectional gas flow having a direction, said internal channel (2) having an intake end for entering said gas flow, and a discharge end for exiting said gas flow; a liquid feed pipe (6) for supplying said liquid into said internal channel (2), said liquid feed pipe (6) having an end furnished with a spray nozzle (3) placed within said internal channel (2) at a predetermined angle to said direction of the gas flow, said spray nozzle (3) producing a spray conical distribution of liquid particles of different sizes, wherein a specific sector of the spray conical distribution corresponds to a specific particle size; a collector (4) for collecting particles of the liquid of a predetermined size, said collector (4) is disposed in a predetermined sector of said spray conical distribution with respect to the predetermined size of particles at the discharge end of said internal channel (2); a returning pipe (5) having a first end connected to said collector (4) and a second end substantially associated with said spray nozzle (3) for re-spraying the liquid;

inputting said gas flow into said intake end of the internal channel (2);

inputting said liquid via said spray nozzle into the internal channel (2);

collecting particles of the liquid of said predetermined size; and returning the collected particles of the liquid of said predetermined size to said spray nozzle (3) for re-spraying.

2. A device for selective-recirculating spraying a liquid comprising:

a body (1) with an internal channel (2) capable of creating a laminar unidirectional gas flow having a direction, said internal channel (2) having an intake end for entering said gas flow, and a discharge end for exiting said gas flow;

a liquid feed pipe (6) for supplying said liquid into said internal channel (2), said liquid feed pipe (6) having an end furnished with a spray nozzle (3) placed within said internal channel (2) at a predetermined angle to said direction of the gas flow, said spray nozzle (3) producing a spray conical distribution of liquid particles of different sizes, wherein a specific sector of the spray conical distribution corresponds to a specific particle size;

a collector (4) for collecting particles of the liquid of a specified size, said collector (4) is disposed in a predetermined sector of said spray conical distribution with respect to the predetermined size of particles at the discharge end of said internal channel (2); and a returning pipe (5) having a first end connected to said collector (4) and a second end substantially associated with said spray nozzle (3) for re-spraying the liquid.

3. A device for selective-recirculating spraying a liquid comprising:

a body (1) with an internal channel (2) capable of creating a laminar unidirectional gas flow having a direction, said internal channel (2) having an intake end for entering said gas flow, and a discharge end for exiting said gas flow;

a liquid feed pipe (6) for supplying said liquid into said internal channel (2), said liquid feed pipe (6) having an end furnished with a first spray nozzle (3) placed within said internal channel (2) at a predetermined angle to said direction of the gas flow;

a second spray nozzle (7) placed within said internal channel (2) at a predetermined angle to said direction of the gas flow, thereby producing a spray conical distribution of liquid particles of different sizes, wherein a specific sector of the spray conical distribution corresponds to a specific particle size;

a collector (4) for collecting particles of the liquid of a predetermined size, said collector (4) is disposed in a predetermined sector of said spray conical distribution with respect to the predetermined size of particles at the discharge end of said internal channel (2);

a returning pipe (5) having a first end connected to said collector (4) and a second end connected to said second spray nozzle (7) for re-spraying the liquid, thereby providing for a conical distribution of liquid particles of the predetermined size;

wherein said second spray nozzle (7) is placed to be capable of overlaying said conical distribution of liquid particles of the predetermined size on said conical distribution of liquid particles of different sizes.

4. A method for selective-recirculating spraying liquid comprising the steps of:

providing the device according to claim 3;

inputting said gas flow into said intake end of the internal channel (2);

inputting said liquid via said spray nozzle (3) into the internal channel (2);

collecting particles of the liquid of said predetermined size; and returning the collected particles of the liquid of said predetermined size to said second spray nozzle (7) for re-spraying.

* * * * *